US005884594A

United States Patent [19]

Wiehle

[11] Patent Number: 5,884,594

[45] Date of Patent: Mar. 23, 1999

[54] VALVE COVER SYSTEM FOR MOTORS

[76] Inventor: David C. Wiehle, 16632 Rte. 38, Maple Park, Ill. 60151

[21] Appl. No.: 980,506

[22] Filed: Dec. 1, 1997

[51] Int. Cl.[6] ..... F01M 9/10

[52] U.S. Cl. ..... 123/90.38; 123/90.41; 123/195 C

[58] Field of Search ..... 123/90.38, 90.39, 123/90.41, 90.43, 90.45, 195 C, 198 E

[56] References Cited

U.S. PATENT DOCUMENTS

| | | | |
|---|---|---|---|
| 5,095,860 | 3/1992 | Newell | 123/90.38 |
| 5,365,901 | 11/1994 | Kiczek | 123/90.38 |
| 5,560,265 | 10/1996 | Miller | 123/90.41 |
| 5,645,025 | 7/1997 | Caya et al. | 123/90.38 |
| 5,655,489 | 8/1997 | Kammerer et al. | 123/90.38 |

*Primary Examiner*—Weilun Lo
*Attorney, Agent, or Firm*—John R. Hoffman

[57] ABSTRACT

A valve cover system is disclosed for use in a piston-and-cylinder type motor which includes a cylinder head assembly including a row of piston rods and valves operatively associated with respective rocker arms. A stud projects through each rocker arm and an adjusting nut is threaded on each stud for adjusting the position of the respective rocker arm. An elongated stud girdle extends along the row for unitarily locking the adjusting nuts together. At least one mounting post projects upwardly from the stud girdle. A valve cover is provided for covering the cylinder head assembly and is secured to the mounting post projecting from the stud girdle.

14 Claims, 4 Drawing Sheets

VALVE COVER SYSTEM FOR MOTORS

FIELD OF THE INVENTION

This invention generally relates to the art of piston-and-cylinder type motors and, particularly, to a valve cover system for such motors.

BACKGROUND OF THE INVENTION

A typical piston-and-cylinder type motor generally includes a plurality of pistons/cylinders in one or more rows and including a cylinder head assembly. The cylinder head assembly includes a piston rod and at least one valve for each piston/cylinder, operatively associated with a respective rocker arm. A stud projects through each rocker arm, and an adjusting nut is threaded onto each stud for adjusting the position of the rocker arm.

Typically, an elongated valve cover encloses the cylinder head assembly and is secured to the cylinder head most commonly by one of two arrangements. First, the cover is provided with a peripheral flange or lip, and the cover is secured directly to the cylinder head by bolts or other fasteners extending through the peripheral flange. In some vehicles, the peripheral flange seats on top of a narrow rib projecting upwardly from the cylinder head, and the flange cannot be used to fasten the cover to the head, because the rib is too narrow for receiving the bolts or fasteners. In those instances, a second fastening system is used whereby bolts or studs project upwardly from the cylinder head between adjacent cylinders and through a top wall of the cover to, thereby, fasten the cover to the cylinder head.

In some engines or motors, a stud girdle is used to interlock the adjusting nuts for the rocker arms. A typical stud girdle is a two-part structure which is elongated and is used to clamp the adjusting nuts therebetween. The stud girdle locks all of the adjusting nuts together, prevents the nuts from rotating and also prevents an individual stud (to which the adjusting nuts are secured) from bending because all of the nuts are "unitized" by the stud girdle. Some engines or motors, including the engine blocks and cylinder heads, are fabricating of aluminum or an aluminum alloy material which can expand and contract considerably in response to heat variances. This can cause one or more of the adjusting nuts to become loose which, in turn, results in lost horsepower for the motor. The stud girdle locks the adjusting nuts and prevents such losses.

Unfortunately, when using a stud girdle, and when the valve cover cannot be secured to the cylinder head by means of the peripheral flange of the cover, there is no way to secure the cover to the cylinder head because the stud girdle forms a barrier for any bolts to extend upwardly from the cylinder head to the top wall of the cover. Consequently, in those types of engines, the use of a stud girdle is prevented and the considerable advantages thereof cannot be utilized.

The present is directed to solving these problems by providing a valve cover system in which the valve cover is mounted directly to the stud girdle.

SUMMARY OF THE INVENTION

An object, therefore, of the invention is to provide a new and improved valve cover system of the character described.

The system is disclosed herein in conjunction with a piston-and-cylinder type motor which includes a cylinder head assembly including a row of piston rods and valves operatively associated with respective rocker arms. A stud projects through each rocker arm, and an adjusting nut is threaded onto each stud for adjusting the position of the respective rocker arm.

In the exemplary embodiment of the invention, a valve cover system includes an elongated stud girdle extending along the row of pistons/cylinders for unitarily locking the adjusting nuts together. At least one mounting post projects upwardly from the stud girdle. An elongated valve cover is provided for covering the cylinder head assembly. The valve cover includes means for mounting the cover on said at least one mounting post projecting upwardly from the stud girdle.

As disclosed herein, the valve cover includes a top wall, a pair of major side walls and a pair of minor end walls. One of the end walls is stepped to accommodate the positioning of an engine component, such as an alternator, immediately adjacent the valve cover. The mounting post projects upwardly through the top wall of the cover, and the cover is reinforced for receiving the mounting post. Preferably, a plurality of the mounting posts are spaced longitudinally of the stud girdle. The posts extend upwardly through an elongated reinforcing rib extending longitudinally of the top wall of the cover.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
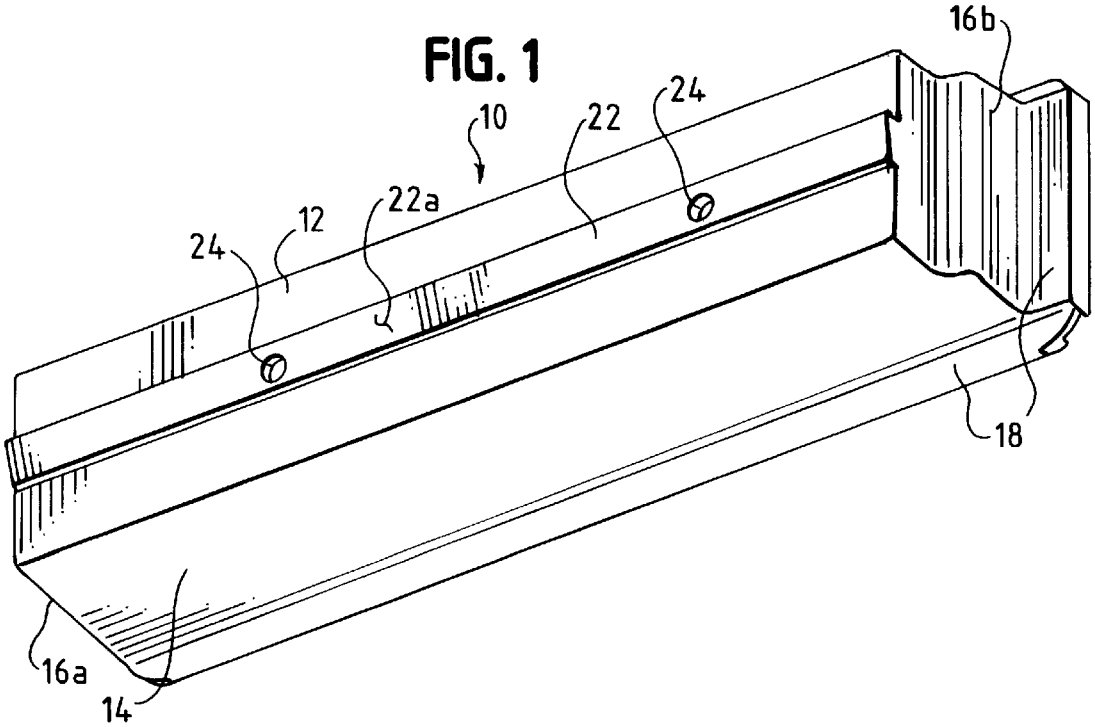
FIG. 1 is a perspective view of the valve cover incorporating the concepts of the invention.
Figure 2:
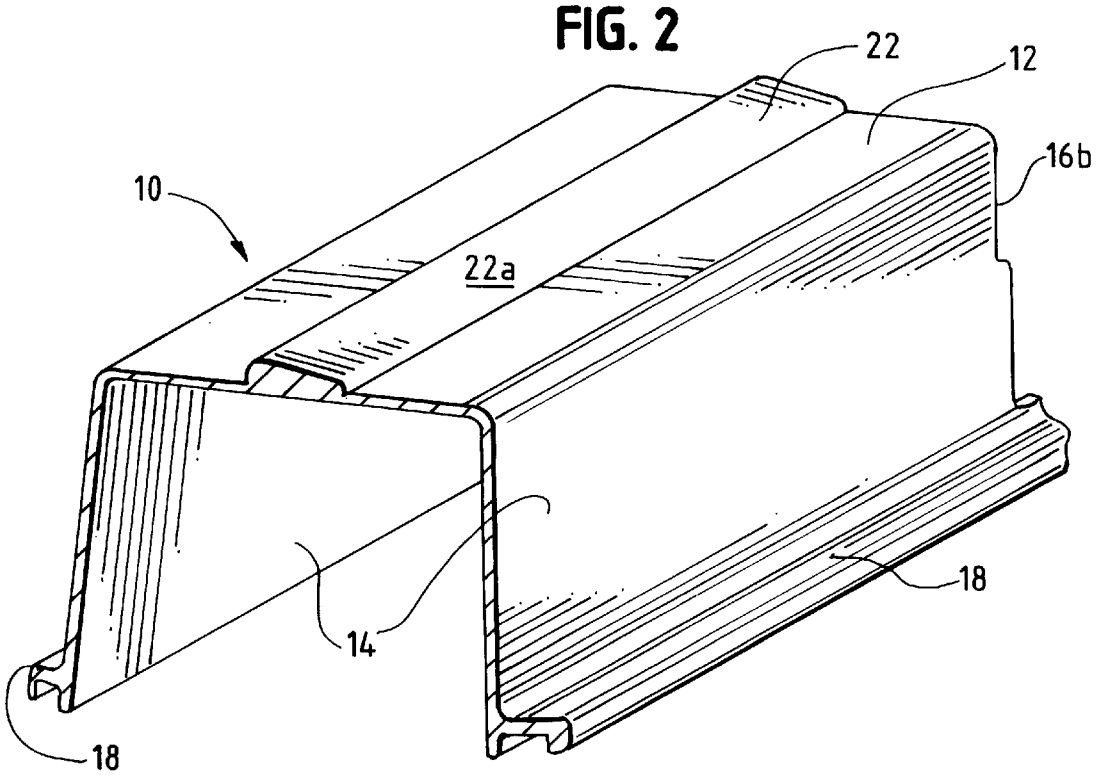
FIG. 2 is a perspective view, in section, taken generally along line 2—2 of FIG. 1.

Referring to the drawings in greater detail, and first to FIGS. 1 and 2, the valve cover system of the invention includes a valve cover, generally designated 10, which has a conventional configuration substantially of an inverted U-shape in section. The valve cover includes a top wall 12, opposite peripheral major (long) side walls 14 and opposite peripheral minor (short) end walls 16*a* and 16*b*. A flange or lip 18 runs about the valve cover along the bottom of the side walls and end walls. The lip seats on top of a rib structure 20 (FIG. 3) projecting upwardly from the cylinder head of the motor. Therefore, the cover cannot be secured to the motor by fastening means, such as bolts, extending through lip 18, because ribs 20 do not provide sufficient support structure for the fastening bolts.

Still referring to FIGS. 1 and 2, an elongated, thickened reinforcing rib 22 runs longitudinally in the center of top wall 12 of valve cover 10. A pair of mounting holes 24 extend through the reinforcing rib and, thereby, through the top wall of the cover. The top surface 22*a* of the rib is slanted relative to top wall 12 to provide flush engagement with mounting nuts, as described hereinafter. Finally, end wall 16*b* of the cover is stepped as seen best in FIG. 1, to accommodate the positioning of an engine component, such as an alternator, immediately adjacent one end of the valve cover.

Figure 3:
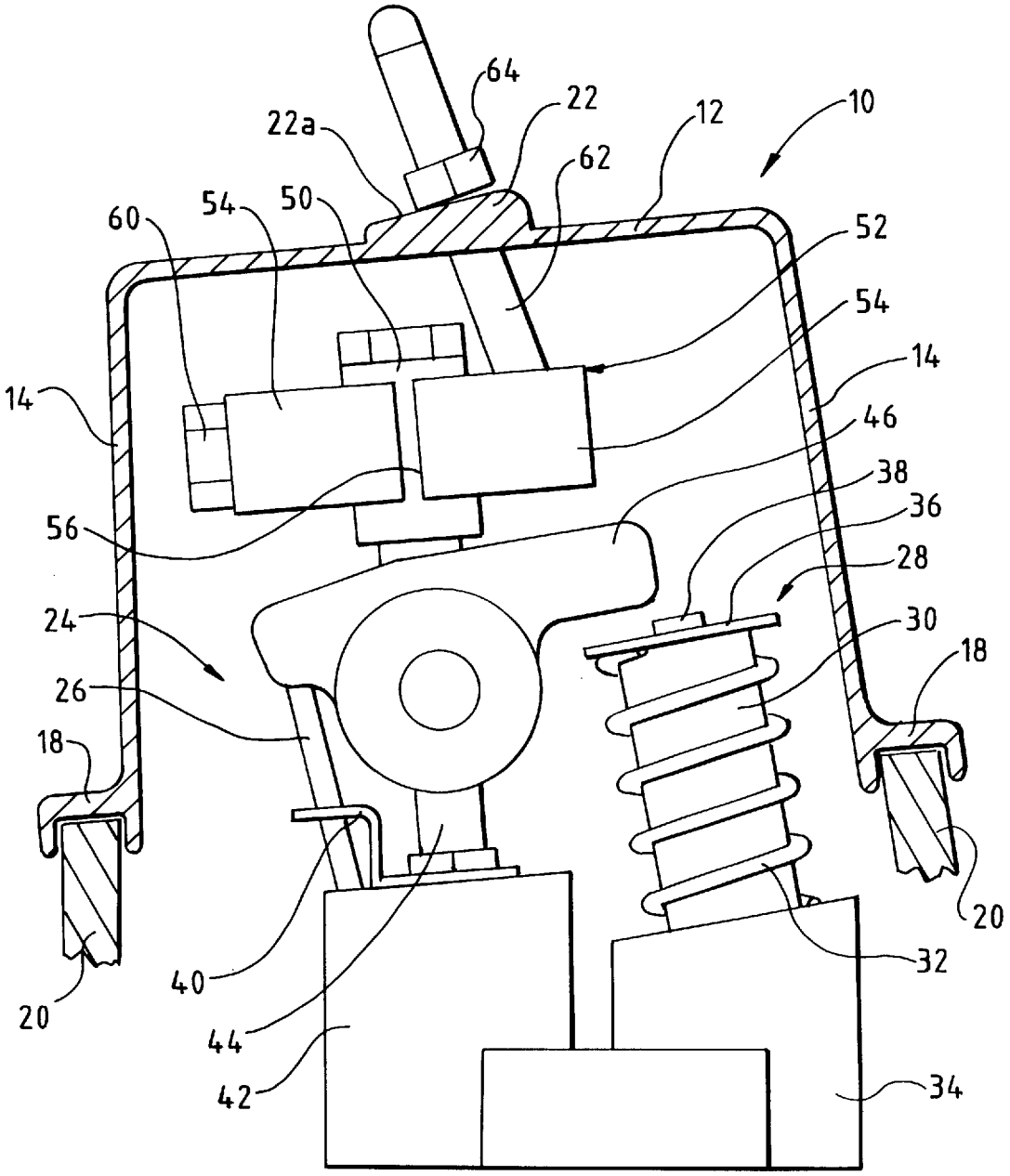
FIG. 3 is a section through the valve cover positioned over the cylinder head assembly.
Figure 4:
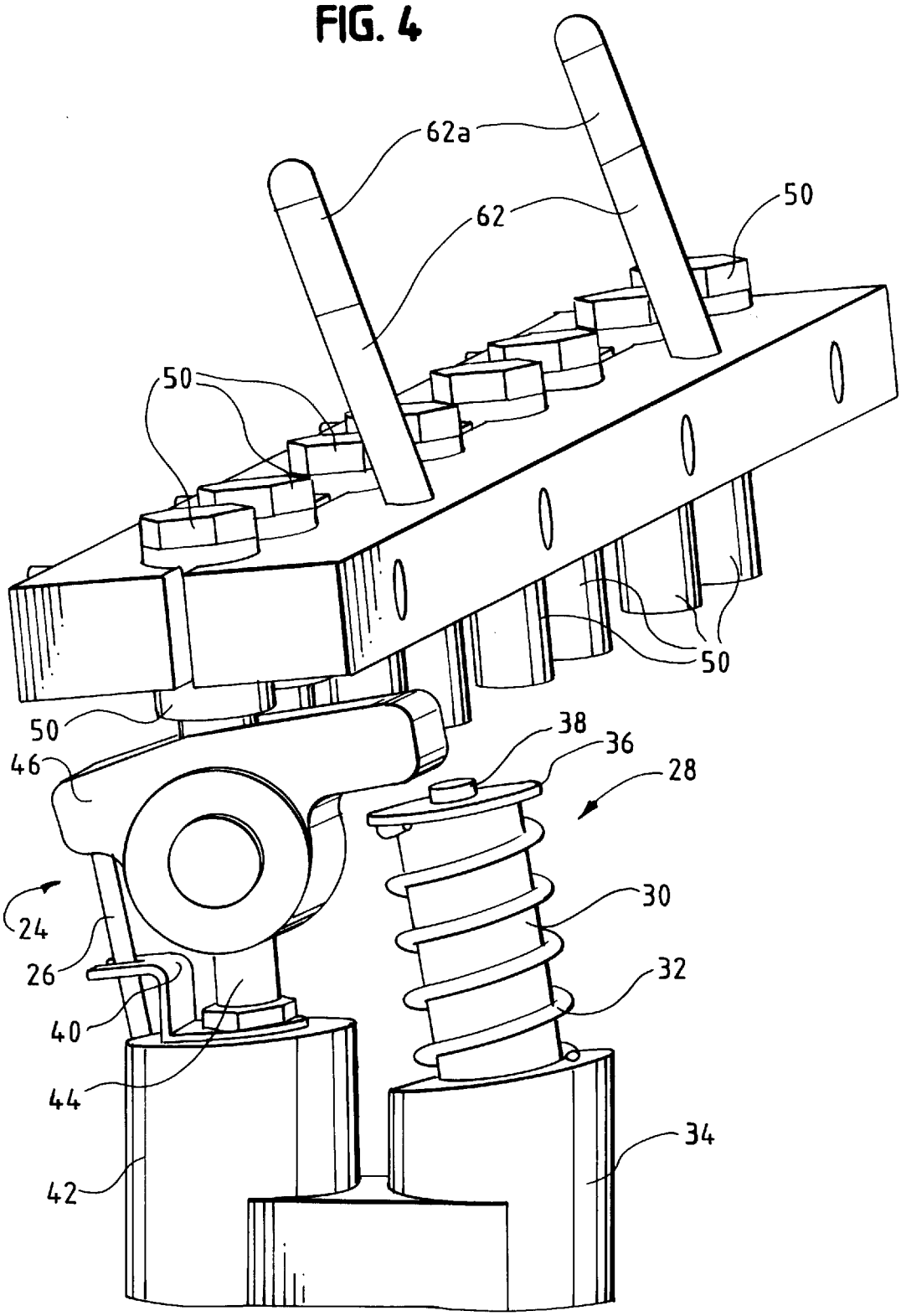
FIG. 4 is a perspective view of the cylinder head assembly, including the stud girdle, but with the valve cover removed to facilitate the illustration.

Referring to FIGS. 3 and 4, a cylinder head assembly, generally designated 24, is shown as might be provided along a cylinder head of a typical piston-and-cylinder type vehicle motor or engine. The cylinder head assembly, includes a row of piston push rods 26 spaced laterally of a row of valves, generally designated 28. Although only one push rod 26 and valve 28 is shown in the drawings, it should be understood that there is a rod and valve for each piston/cylinder lengthwise of the cylinder head. All are not shown to avoid cluttering the illustration. In any event, valve 28 includes a valve end 30 biased upwardly by a coil spring 32 sandwiched between the cylinder head 34 and an enlarged washer 36 secured by a bolt 38 to the top of the valve end. Push rod 26 extends upwardly through a bifurcated bracket or guide 40 secured to the top of a cylinder head boss 42. An externally threaded stud 44 projects upwardly from boss 42.

Figure 5:
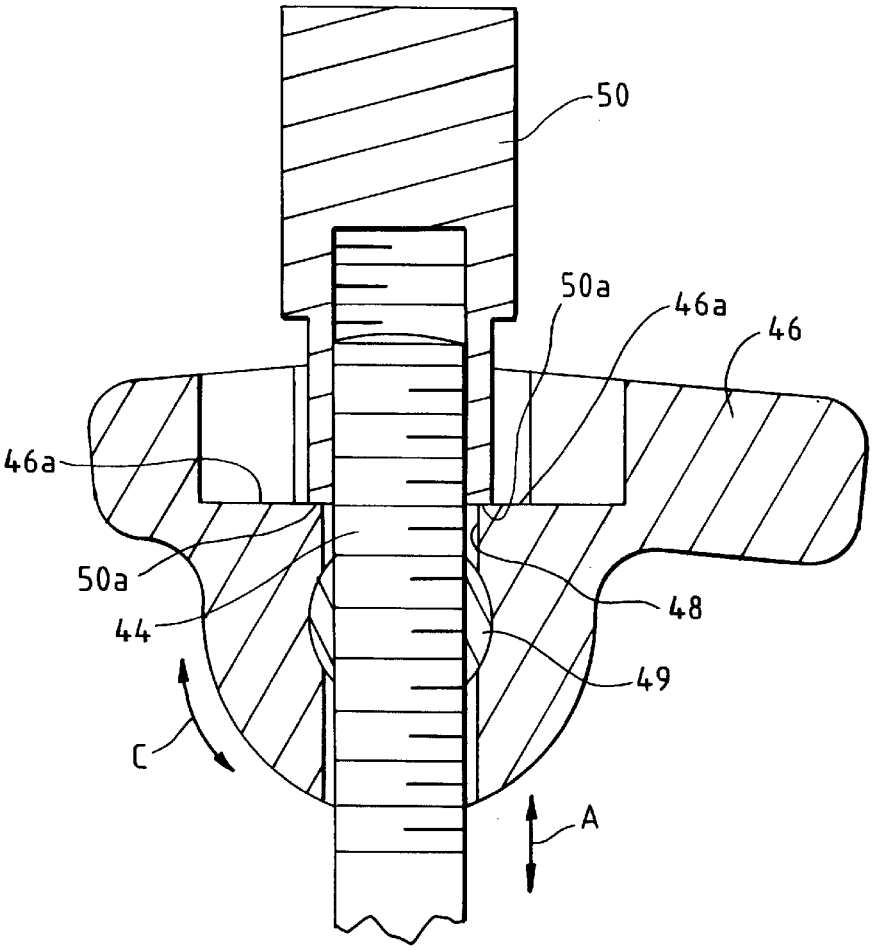
FIG. 5 is a vertical section through one of the rocker arms, showing the interengagement of one of the adjusting nuts with the stud projecting upwardly from the cylinder head.

Referring to FIG. 5 in conjunction with FIGS. 3 and 4, a rocker arm 46 has a through passage 48 into which externally threaded stud 44 projects from the bottom thereof. The stud projects through a transverse pivot shaft 49 on which the rocker arm rocks in the direction of double-headed arrow "C". The rocker arm is secured to stud 44 by an adjusting nut 50 threaded onto stud 44. The adjusting nut includes a shoulder 50*a* for engaging a shoulder 46*a* of the rocker arm. Therefore, rotation of adjusting nut 50 on stud 40 adjusts the vertical position of the rocker arm as indicated by arrow "A" (FIG. 5). Of course, as is known in the art, rocker arm 46 is operatively associated with its respective push rod 26 and valve 28 for the respective piston/cylinder of the motor. Again, as is known, there is a push rod, valve, stud, rocker arm and adjusting nut for each piston/cylinder in the row thereof along the cylinder head.

Figure 6:
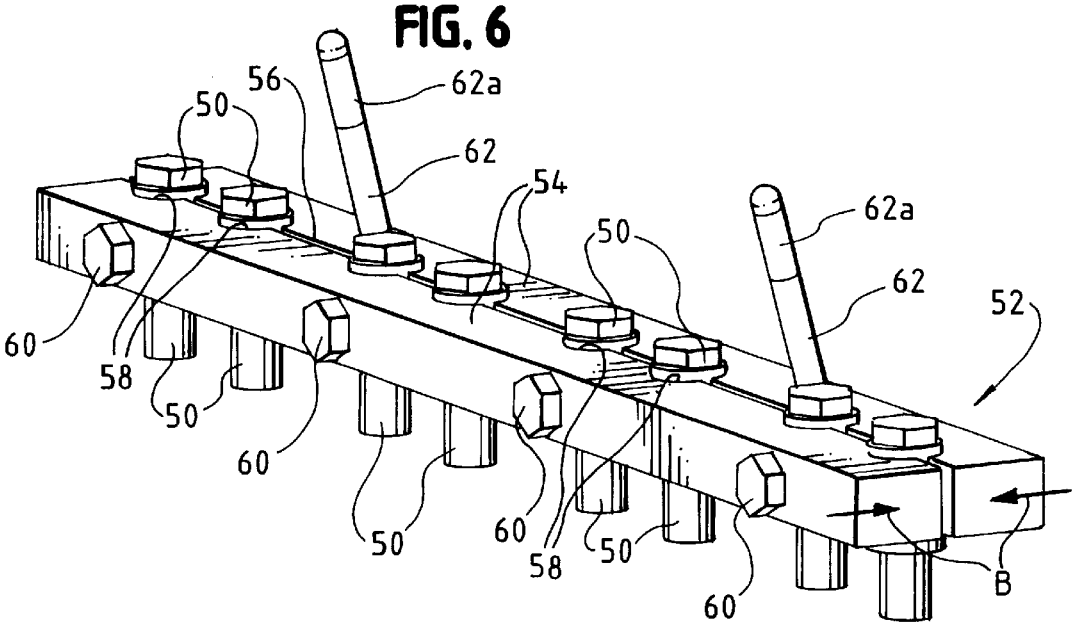
FIG. 6 is a perspective view of the stud girdle clamped onto a plurality of the rocker arm adjusting nuts, isolated from the remainder of the cylinder head assembly to facilitate the illustration.

Referring to FIG. 6 in conjunction with FIGS. 3 and 4, a stud girdle, generally designated 52, extends lengthwise along the array of piston/cylinders and is provided for unitizing or locking together all of the adjusting nuts 50. The stud girdle actually is formed by two elongated bars 54 facing each other at an interface 56 which includes a plurality of arcuate recesses 58 to solidly embrace the adjusting nuts 50. Elongated bars 50 of stud girdle 52 are secured together transversely by a plurality of bolts 60 which extend freely through one of the bars and are threaded into internally-threaded bores in the other bar. Therefore, the two bars can be drawn together in the direction of arrows "B" (FIG. 6) to lockingly clamp adjusting nuts 50 between the bars. In essence, the stud girdle unitizes the adjusting nuts, prevents the nuts from rotating and prevents any individual stud 44 from bending relative to the other studs. When it is desirable to adjust one of the rocker arms 46, the bars of the stud girdle are loosened by bolts 60, one or more of the adjusting nuts 50 then can be rotated, and the stud girdle is then clamped back onto all of the adjusting nuts.

Generally, the invention contemplates means for securing valve cover 10 onto the cylinder head by mounting the cover directly to stud girdle 52. This is seen in FIG. 3.

More particularly, at least one mounting post 62 is fixed to one of the bars 54 of the stud girdle and projects upwardly through top wall 12 and reinforcing rib 22 of the cover. In the illustrated embodiment, 20 a pair of the mounting posts 62 project upwardly from the stud girdle at spaced intervals longitudinally thereof. The mounting posts extend through mounting holes 24 in rib 22 which extends longitudinally of the top wall of the cover. The mounting posts are externally threaded, as at 62*a*, for receiving internally threaded nuts 64 which draw the cover down onto ribs 20 on the cylinder head.

Reinforcing rib 22 along the top wall of the cover prevents the cover from unnecessarily bending inwardly or downwardly. The reinforcing rib is shown integral with the cover. The cover might be fabricated as a cast component, at least partially extruded component or a stamped and formed or drawn component depending upon the materials involved and the uses intended. Typically, the cover is fabricated of metal material.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a piston-and-cylinder type motor which includes a cylinder head assembly including a row of push rods and valves operatively associated with respective rocker arms, a stud projecting through each rocker arm and an adjusting nut on each stud for adjusting the position of the respective rocker arm, a valve cover mounting system comprising:

an elongated stud girdle extending along said row for unitarily locking the adjusting nuts together;

at least one mounting post projecting upwardly from the stud girdle; and an elongated valve cover for covering said cylinder head assembly and including means for mounting the cover on said at least one mounting post projecting upwardly from the stud girdle.

2. The valve cover system of claim 1 wherein said valve cover includes a top wall and peripheral side walls, and the mounting post projects from the stud girdle through the top wall of the cover.

3. The valve cover system of claim 2 wherein said top wall of the valve cover includes a reinforcing portion through which the mounting post projects.

4. The valve cover system of claim 1, including a plurality of said mounting posts spaced longitudinally of the stud girdle.

5. The valve cover system of claim 1 wherein said valve cover includes a top wall, a pair of major side walls and a pair of minor end walls, one of the end walls being stepped to accommodate the positioning of an engine component immediately adjacent the valve cover.

6. The valve cover system of claim 1 wherein said valve cover includes wall means having a thickened reinforcing portion through which the mounting post projects.

7. In a piston-and-cylinder type motor which includes a cylinder head assembly including a row of push rods and valves operatively associated with respective rocker arms, a stud projecting through each rocker arm and an adjusting nut on each stud for adjusting the position of the respective rocker arm, a valve cover mounting system comprising:

an elongated stud girdle extending along said row for unitarily locking the adjusting nuts together;

a plurality of mounting posts spaced longitudinally of the stud girdle and extending upwardly therefrom; and an elongated valve cover for covering said cylinder head assembly, the valve cover including a top wall and peripheral side walls and a reinforced portion on the top wall through which the mounting posts project for mounting the cover on the mounting posts projecting upwardly from the stud girdle.

8. The valve cover system of claim 7 wherein said reinforced portion of the cover comprises a thickened rib extending longitudinally of the top wall of the cover and including a plurality of holes through which the plurality of mounting posts extend.

9. The valve cover system of claim 7 wherein said valve cover includes a pair of major side walls and a pair of minor end walls, one of the end walls being stepped to accommodate the positioning of an engine component immediately adjacent the valve cover.

10. In a piston-and-cylinder type motor which includes a cylinder head assembly including a plurality of push rods and valves operatively associated with respective rocker arms and adjusting members for adjusting the rocker arms, a valve cover system comprising:

a girdle member for unitarily locking the adjusting members together;

a valve cover for covering the cylinder head assembly; and means mounting the valve cover directly to the stud girdle.

11. The valve cover system of claim 10 wherein said valve cover includes a top wall and peripheral side walls, and said mounting means projects from the girdle through the top wall of the cover.

12. The valve cover system of claim 11 wherein said mounting means comprises a plurality of spaced mounting posts projecting from the girdle member through the top wall of the cover.

13. The valve cover system of claim 12 wherein said top wall of the cover includes reinforcing means at the points where the mounting posts extend therethrough.

14. The valve cover system of claim 10 wherein said valve cover includes a top wall, a pair of major side walls and a pair of minor end walls, one of the end walls being stepped to accommodate the positioning of an engine component immediately adjacent the valve cover.

* * * * *